US006095846A

United States Patent [19]

Becerra

[11] Patent Number: 6,095,846

[45] Date of Patent: Aug. 1, 2000

[54] ELECTRICAL PLUG RETAINER

[76] Inventor: Faustino Becerra, 1512 W. 800 North, Salt Lake City, Utah 84116

[21] Appl. No.: 09/314,917

[22] Filed: May 20, 1999

[51] Int. Cl.[7] ..... H01R 13/62

[52] U.S. Cl. ..... 439/371; 439/373

[58] Field of Search ..... 439/373, 371, 439/369

[56] References Cited

U.S. PATENT DOCUMENTS 4,045,108 8/1977 Olsen ..... 439/373

*Primary Examiner*—Lincoln Donovan
*Assistant Examiner*—Javaid Nasri

[57] ABSTRACT

A electrical plug retainer for securing an electrical plug inserted into a socket of an electrical receptacle. The electrical plug retainer includes a spaced apart pair of elongate members each has a pair of opposite ends, a spaced apart pair of elongate end regions and a middle region interposed between the end regions of the respective elongate member. A plurality of spaced apart cross members are extended between the middle portions of the middle regions of the elongate members. A plurality of couplers are provided each having spaced apart first and second pairs of generally bores therethrough. The end regions of the elongate members each are inserted through an associated bore of each coupler such that the couplers couple opposite end regions of the same elongate member together.

7 Claims, 2 Drawing Sheets

ELECTRICAL PLUG RETAINER

BACKGROUND OF THE INVENTION

1. Field of the Invention

The present invention relates to electrical plug retainers and more particularly pertains to a new electrical plug retainer for securing an electrical plug inserted into a socket of an electrical receptacle.

2. Description of the Prior Art

The use of electrical plug retainers is known in the prior art. More specifically, electrical plug retainers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,690,474; 4,083,618; 3,639,886; 2,470,320; 4,618,200; and U.S. Pat. No. Des. 325,562.

While these devices fulfill their respective, particular objectives and requirements, the aforementioned patents do not disclose a new electrical plug retainer. The inventive device includes a spaced apart pair of elongate members each has a pair of opposite ends, a spaced apart pair of elongate end regions and a middle region interposed between the end regions of the respective elongate member. A plurality of spaced apart cross members are extended between the middle portions of the middle regions of the elongate members. A plurality of couplers are provided each having spaced apart first and second pairs of generally bores therethrough. The end regions of the elongate members each are inserted through an associated bore of each coupler such that the couplers couple opposite end regions of the same elongate member together.

In these respects, the electrical plug retainer according to the present invention substantially departs from the conventional concepts and designs of the prior art, and in so doing provides an apparatus primarily developed for the purpose of securing an electrical plug inserted into a socket of an electrical receptacle.

SUMMARY OF THE INVENTION

In view of the foregoing disadvantages inherent in the known types of electrical plug retainers now present in the prior art, the present invention provides a new electrical plug retainer construction wherein the same can be utilized for securing an electrical plug inserted into a socket of an electrical receptacle.

The general purpose of the present invention, which will be described subsequently in greater detail, is to provide a new electrical plug retainer apparatus and method which has many of the advantages of the electrical plug retainers mentioned heretofore and many novel features that result in a new electrical plug retainer which is not anticipated, rendered obvious, suggested, or even implied by any of the prior art electrical plug retainers, either alone or in any combination thereof.

To attain this, the present invention generally comprises a spaced apart pair of elongate members each has a pair of opposite ends, a spaced apart pair of elongate end regions and a middle region interposed between the end regions of the respective elongate member. A plurality of spaced apart cross members are extended between the middle portions of the middle regions of the elongate members. A plurality of couplers are provided each having spaced apart first and second pairs of generally bores therethrough. The end regions of the elongate members each are inserted through an associated bore of each coupler such that the couplers couple opposite end regions of the same elongate member together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electrical plug retainer apparatus and method which has many of the advantages of the electrical plug retainers mentioned heretofore and many novel features that result in a new electrical plug retainer which is not anticipated, rendered obvious, suggested, or even implied by any of the prior art electrical plug retainers, either alone or in any combination thereof.

It is another object of the present invention to provide a new electrical plug retainer which may be easily and efficiently manufactured and marketed.

It is a further object of the present invention to provide a new electrical plug retainer which is of a durable and reliable construction.

An even further object of the present invention is to provide a new electrical plug retainer which is susceptible of a low cost of manufacture with regard to both materials and labor, and which accordingly is then susceptible of low prices of sale to the consuming public, thereby making such electrical plug retainer economically available to the buying public.

Still yet another object of the present invention is to provide a new electrical plug retainer which provides in the apparatuses and methods of the prior art some of the advantages thereof, while simultaneously overcoming some of the disadvantages normally associated therewith.

Still another object of the present invention is to provide a new electrical plug retainer for securing an electrical plug inserted into a socket of an electrical receptacle.

Yet another object of the present invention is to provide a new electrical plug retainer which includes a spaced apart pair of elongate members each has a pair of opposite ends, a spaced apart pair of elongate end regions and a middle region interposed between the end regions of the respective elongate member. A plurality of spaced apart cross members are extended between the middle portions of the middle regions of the elongate members. A plurality of couplers are provided each having spaced apart first and second pairs of generally bores therethrough. The end regions of the elongate members each are inserted through an associated bore of each coupler such that the couplers couple opposite end regions of the same elongate member together.

Still yet another object of the present invention is to provide a new electrical plug retainer that prevents electrical plugs from being accidentally pulled out of the sockets of an electrical receptacle.

Even still another object of the present invention is to provide a new electrical plug retainer that prevents children from pulling electrical plugs out of an electrical receptacle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
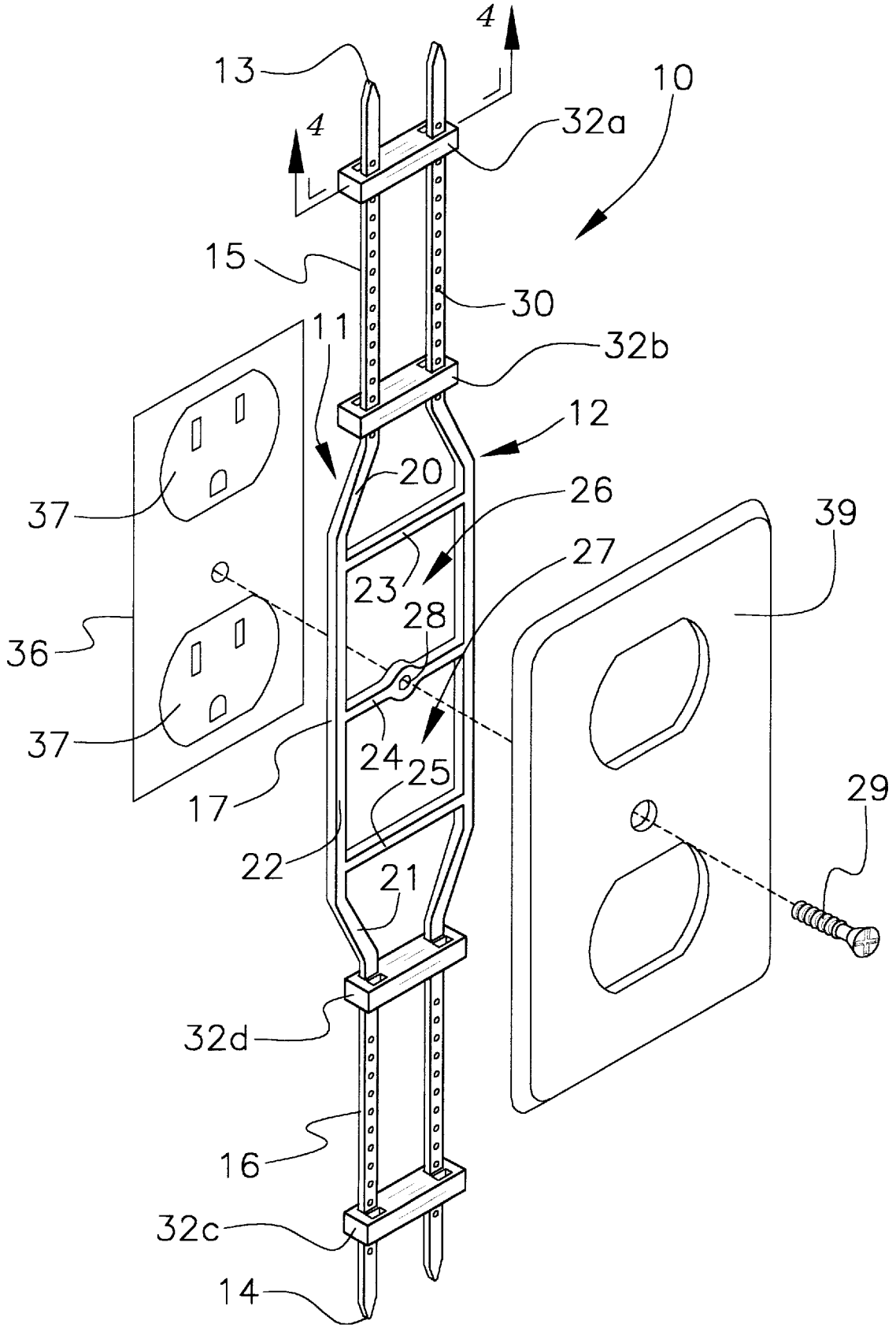
FIG. 1 is a schematic exploded perspective view of one preferred embodiment of a new electrical plug retainer according to the present invention.

With reference now to the drawings, and in particular to FIGS. 1 through 5 thereof, a new electrical plug retainer embodying the principles and concepts of the present invention and generally designated by the reference numeral 10 will be described.

As best illustrated in FIGS. 1 through 5, the electrical plug retainer 10 generally comprises a spaced apart pair of elongate members each has a pair of opposite ends, a spaced apart pair of elongate end regions and a middle region interposed between the end regions of the respective elongate member. A plurality of spaced apart cross members are extended between the middle portions of the middle regions of the elongate members. A plurality of couplers are provided each having spaced apart first and second pairs of generally bores therethrough. The end regions of the elongate members each are inserted through an associated bore of each coupler such that the couplers couple opposite end regions of the same elongate member together.

Figure 2:
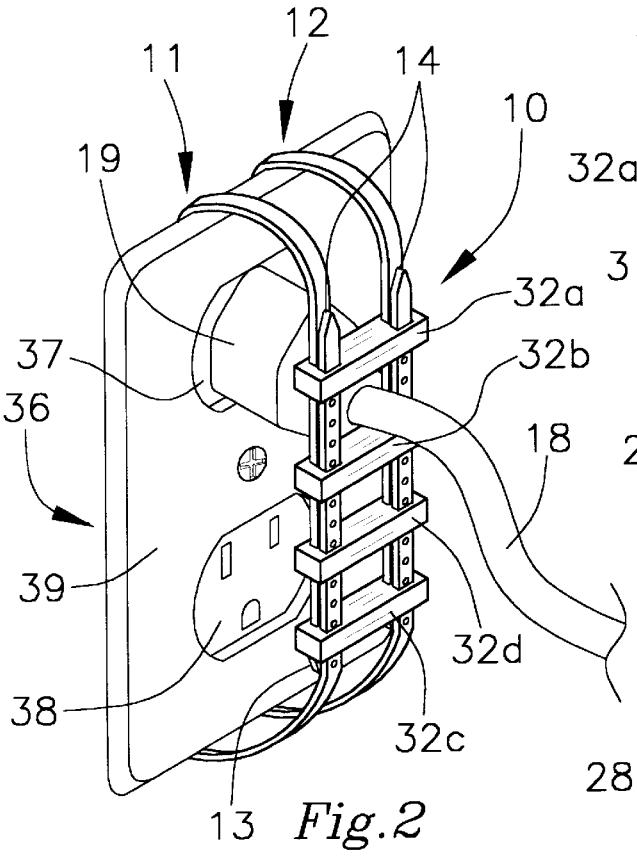
FIG. 2 is a schematic perspective view of the preferred embodiment illustrated in FIG. 1 with the first and second end regions coupled together with the couplers to secure a plug of an electric cord in a socket of the receptacle.

In closer detail, the electrical plug retainer is designed for securing an electrical plug at the end of an electrical cord in a socket of an electrical receptacle. Specifically, the electrical plug retainer 10 comprises a spaced apart pair of elongate members 11,12 each having a pair of opposite ends 13,14, a spaced apart pair of elongate end regions 15,16 and a middle region 17 interposed between the end regions of the respective elongate member. A first end region 15 of the pair of end regions of each elongate member is positioned adjacent a first of the ends 13 of the respective elongate member. A second end region 16 of the pair of end regions of each elongate member is positioned adjacent a second of the ends 14 of the respective elongate member. The first end regions of the elongate members are extended substantially parallel to one another and the second end regions of the elongate members are extended substantially parallel to one another. As best illustrated in FIG. 2, the end regions are designed for extending an elongate flexible electrical cord 18 therebetween and are apart a distance less that an electrical plug 19 on the end of the electrical cord to prevent passage of the plug between the adjacent end regions.

The middle regions of the elongate members each preferably comprise a pair of end portions 20,21 and a middle portion 22 interposed between the end portions of the respective middle region. The middle portions of the middle regions are extended substantially parallel to one another. The end portions of each middle region are extended at an obtuse angle to the associated middle portion of the respective middle region.

A plurality of spaced apart and substantially parallel elongate cross members 23,24,25 are extended between the middle portions of the middle regions of the elongate members. The plurality of cross members preferably comprises first, second and third cross members. The second cross member 24 is interposed between the first and third cross members 23,25.

The cross members define a pair of generally rectangular socket spaces 26,27 therebetween. A first of the socket spaces 26 is defined between the first and second cross members 23,24 and a second of the socket spaces 27 is defined between the second and third cross members 24,25.

Preferably, the second cross member has a generally circular hole 28 therethrough located in an generally circular extent substantially equidistantly positioned between the middle regions of the elongate members. As illustrated in FIG. 1, this hole of the second cross member is adapted for extending a threaded fastener 29 therethrough.

With reference to FIG. 1, in one preferred embodiment, the end regions of the elongate members each may have a spaced apart plurality holes 30 therethrough extending in a row along the respective end region. The holes of each end region are spaced apart at substantially equal intervals in the respective row.

Figure 3:
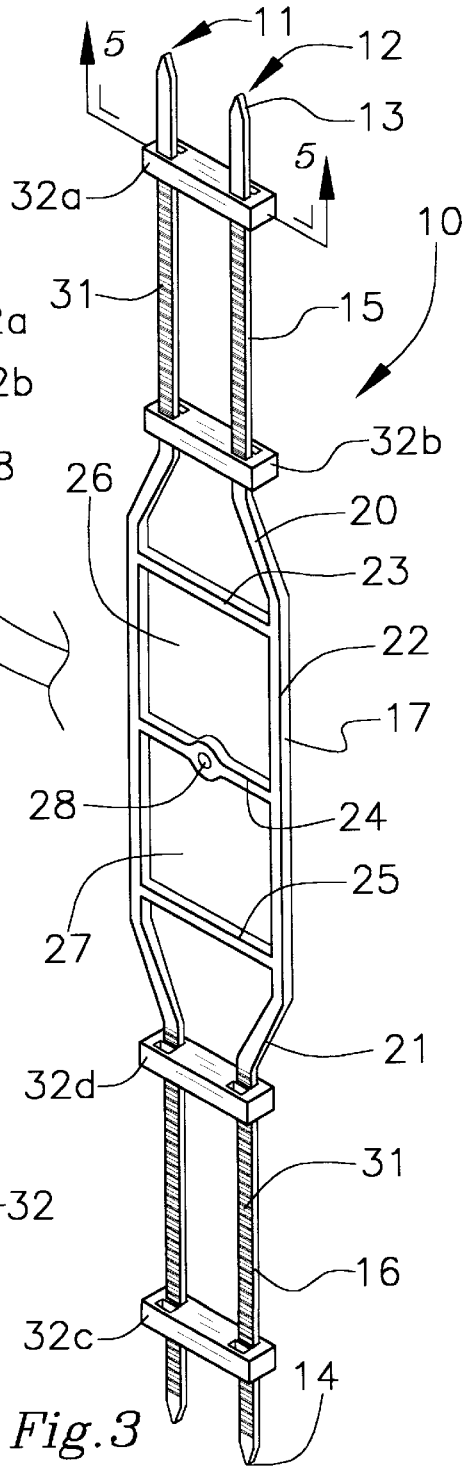
FIG. 3 is a schematic perspective view of another preferred embodiment of the present invention.

With reference to FIG. 3, in another preferred embodiment, the end regions of the elongate members each may have a spaced apart plurality transverse ridges 31 extending in a row along the respective end region. The transverse ridges of each region is spaced apart at substantially equal intervals in the respective row.

Figure 4:
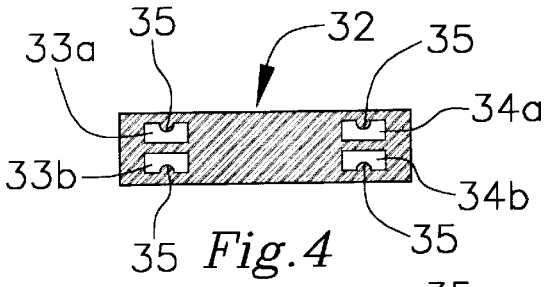
FIG. 4 is a schematic cross sectional view taken from line 4—4 of FIG. 1 of a coupler used in the preferred embodiment illustrated in FIGS. 1 and 2 taken.
Figure 5:
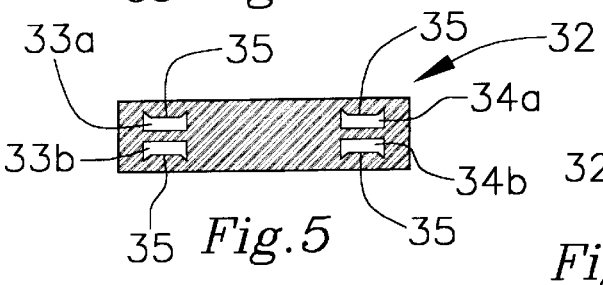
FIG. 5 is a schematic cross sectional view taken from line 5—5 of FIG. 3 of a coupler used in the preferred embodiment illustrated in FIG. 3.

With reference to FIGS. 4 and 5, the electric plug retainer also comprises a plurality of couplers 32 each having spaced apart first and second pairs of generally rectangular bores 33*a*,33*b*,34*a*,34*b* therethrough. Each bore has a resilient extent 35 extending therein with the extents of the first pair of bores opposed to each other and the extents of the second pair of bores opposed to each other. In the hole embodiment of the elongate members illustrated in FIGS. 1 and 2, the extents have a generally semicircular shape as shown in FIG. 4. In the transverse ridge embodiment illustrated in FIG. 5, the extents have a generally trapezoidal shape as shown in FIG. 5.

The couplers comprising first and second pairs of couplers. The first pair of couplers 32*a*,32*b* are associated with the first end regions of the elongate members and the second pair of couplers 32*c*,32*d* are associated with the second end regions of the elongate members. The first pair of bores of each coupler is associated with one of the elongate members 11 and the second pair of bores of each coupler is associated with the other of the elongate members 12. The end regions of each elongate member is extended through one of the bores of the associated pair of bores of the coupler associated with the respective end region as shown in FIGS. 1 and 3.

The extents of the bore (through which the end regions of the elongate members are extended) are inserted into one of the holes of the respective associated end region to hold the respective coupler in a fixed position on the associated end region as shown in FIGS. 1 and 2. In the transverse ridge embodiment, as illustrated in FIG. 3, the extents of the bore (through which the end regions of the elongate members are extended) are inserted between an adjacent pair of transverse ridges of the respective associated end region to hold the respective coupler in a fixed position on the associated end region.

In use, the electrical plug retainer is designed for use with an electrical receptacle 36 has a pair of sockets 37,38 and a cover plate 39 coupled therethrough by a threaded fastener 29 extended through a central hole in the cover plate and into the electrical receptacle. As best shown in FIG. 1, the middle regions of the elongate members are positioned between the electrical receptacle and the cover plate. One of the socket spaces is positioned adjacent one of the sockets of the electrical receptacle and the other of the socket spaces is positioned adjacent the other of the sockets of the electrical receptacle. The threaded fastener is extended through the hole of the second cross member.

The plug 19 of an elongate flexible electric cord 18 is inserted into either one of the sockets. As illustrated in FIG. 2, the first and second end regions of the elongate members are bent over a front face of the cover plate. The first end regions of the elongate members are then inserted through the other bore of an associated pair of bores of the second pair of couplers. Similarly, the second end regions of the elongate members are inserted through the other bore of an associated pair of bores of the first pair of couplers. The extents of the bores engages a corresponding hole in the respective end region or are inserted between an adjacent pair of transverse ridges of the respective end region such that the first end regions are coupled to the second end regions by the couplers as shown in FIG. 2.

The electrical cord is extended between the first pair of couplers and between the end regions of the elongate members. The end region of each elongate member is spaced apart from the associated end region of the other elongate member a distance less than the width of the plug of the electrical cord to prevent pulling out of the plug from between the end regions. Ideally, each pair of couplers are spaced apart a distance less than the width of the plug of the electrical cord to prevent pulling out of the plug from between the pair of couplers as shown in FIG. 2.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical plug retainer for securing an electrical plug in a socket of an electrical receptacle, said electrical plug retainer comprising:

a spaced apart pair of elongate members each having a pair of opposite ends, a spaced apart pair of elongate end regions and a middle region interposed between said end regions of the respective elongate member;

a first of said end regions of each elongate member being positioned adjacent a first of said ends of the respective elongate member, a second of said end regions of each elongate member being positioned adjacent a second of said ends of the respective elongate member;

said first end regions of said elongate member being adapted for extending an electrical cord therebetween and being spaced apart a distance less than a width of a plug at an end of the electrical cord;

a plurality of spaced apart and substantially parallel elongate cross members being extended between said middle portions of said middle regions of said elongate members;

a plurality of couplers each having spaced apart first and second pairs of generally bores therethrough; and said end regions of said elongate members each being inserted through an associated bore of each coupler such that said couplers couple said first end regions to said second end regions.

2. The electrical plug retainer of claim 1, wherein said first end regions of said elongate members are extended substantially parallel to one another, and said second end regions of said elongate members are extended substantially parallel to one another.

3. The electrical plug retainer of claim 1, wherein said middle regions of said elongate members each comprise a pair of end portions and a middle portion interposed between said end portions of the respective middle region, wherein said middle portions of said middle regions are extended substantially parallel to one another, and wherein said end portions of each middle region are extended at an obtuse angle to the associated middle portion of the respective middle region.

4. The electrical plug retainer of claim 1, wherein one of said cross members has a generally circular hole therethrough.

5. The electrical plug retainer of claim 1, wherein said end regions of said elongate members each have a spaced apart plurality of holes therethrough extending in a row along the respective end region.

6. The electrical plug retainer of claim 1, wherein said end regions of said elongate members each have a spaced apart plurality of transverse ridges extending in a row along the respective end region.

7. An electrical plug retainer system for securing an electrical plug in a socket of an electrical receptacle, said electrical plug retainer system comprising:

a spaced apart pair of elongate members each having a pair of opposite ends, a spaced apart pair of elongate end regions and a middle region interposed between said end regions of the respective elongate member;

a first of said end regions of each elongate member being positioned adjacent a first of said ends of the respective elongate member, a second of said end regions of each elongate member being positioned adjacent a second of said ends of the respective elongate member;

said first end regions of said elongate members being extended substantially parallel to one another, said second end regions of said elongate members being extended substantially parallel to one another;

said middle regions of said elongate members each comprising a pair of end portions and a middle portion interposed between said end portions of the respective middle region;

said middle portions of said middle regions being extended substantially parallel to one another, said end portions of each middle region being extended at an obtuse angle to the associated middle portion of the respective middle region;

a plurality of spaced apart and substantially parallel elongate cross members being extended between said middle portions of said middle regions of said elongate members;

wherein said plurality of cross members comprises first, second and third cross members, said second cross member being interposed between said first and third cross members;

said cross members defining a pair of generally rectangular socket spaces therebetween, a first of said pair of socket spaces being defined between said first and second cross members, a second of said pair of socket spaces being defined between said second and third cross members;

said second cross member having a generally circular hole therethrough;

said end regions of said elongate members each having a spaced apart plurality of holes therethrough extending in a row along the respective end region;

a plurality of couplers each having spaced apart first and second pairs of generally rectangular bores therethrough, each bore having a resilient extent extending therein, said extents of said first pair of bores facing one another, said extents of said second pair of bores facing one another;

said couplers comprising first and second pairs of couplers, said first pair of couplers being associated with said first end regions of said elongate members, said second pair of couplers being associated with said second end regions of said elongate members;

said first pair of bores of each coupler being associated with one of said elongate members, said second pair of bores of each coupler being associated with the other of said elongate members;

said end regions of each elongate member being extended through one of the bores of the associated pair of bores of the coupler associated with the respective end region;

said extents of said bore through which said end regions of said elongate members are extended being inserted into one of said holes of the respective associated end region to hold the respective coupler in a fixed position on the associated end region;

an electrical receptacle having a pair of sockets and a cover plate coupled therethrough by a threaded fastener extended through a central hole in said cover plate and into said electrical receptacle;

said middle regions of said elongate members being positioned between said electrical receptacle and said cover plate;

one of said socket spaces being positioned adjacent one of said sockets of said electrical receptacle, the other of said socket spaces being positioned adjacent the other of said sockets of said electrical receptacle;

said threaded fastener being extended through said hole of said second cross member;

an elongate flexible electric cord having a plug inserted into one of said sockets;

said first and second end regions of said elongate members being bent over a front face of said cover plate, said first end regions of said elongate members being inserted through the other bores each pair of bores of said second pair of couplers and said second end regions of said elongate members being inserted through the other bores each pair of bores of said first pair of couplers with said extents of said other bore engaging said hole such that said first end regions are coupled to said second end regions by said couplers;

said electrical cord being extended between said first pair of couplers and between said end regions of said elongate members; and said end region of each elongate member being spaced apart from the associated end regions of the other elongate member a distance less than the width of the plug of the electrical cord to prevent pulling out of said plug from between said end regions, wherein said first pair of couplers are spaced apart a distance less than the width of the plug of the electrical cord to prevent pulling out of said plug from between said first pair of couplers.

* * * * *